US009051706B1

(12) United States Patent
Ludwig

(10) Patent No.: US 9,051,706 B1
(45) Date of Patent: Jun. 9, 2015

(54) HELICAL PIER WITH ADJUSTABLE PIERHEAD PLATES FOR SUPPORTING A STRUCTURE ABOVE A GROUND SURFACE

(71) Applicant: Michael R. Ludwig, Englewood, CO (US)

(72) Inventor: Michael R. Ludwig, Englewood, CO (US)

( * ) Notice: Subject to any disclaimer, the term of this patent is extended or adjusted under 35 U.S.C. 154(b) by 70 days.

(21) Appl. No.: 13/952,949

(22) Filed: Jul. 29, 2013

(51) Int. Cl.

| | |
|---|---|
| ***E02D 5/56*** | (2006.01) |
| ***E02D 5/28*** | (2006.01) |
| ***E02D 5/76*** | (2006.01) |
| ***E02D 5/34*** | (2006.01) |
| ***E02D 5/54*** | (2006.01) |

(52) U.S. Cl.
CPC .. *E02D 5/76* (2013.01); *E02D 5/34* (2013.01); *E02D 5/54* (2013.01)

(58) Field of Classification Search
CPC ..... E02D 5/22; E02D 5/223; E02D 5/24; E02D 5/28; E02D 5/285; E02D 5/30; E02D 5/34; E02D 5/54; E02D 5/56; E02D 5/74; E02D 5/80; E02D 5/801
USPC ..... 405/229, 230, 231, 232, 233, 239, 405/252.1, 256; 175/323, 394; 52/153, 154, 52/157, 165
See application file for complete search history.

(56) References Cited

U.S. PATENT DOCUMENTS

| | | | | |
|---|---|---|---|---|
| 3,832,861 | A * | 9/1974 | Jahnke et al. | 52/127.5 |
| 4,614,462 | A * | 9/1986 | Itou | 405/232 |
| 5,934,836 | A | 8/1999 | Rupiper et al. | |
| 6,503,024 | B2 * | 1/2003 | Rupiper | 405/230 |
| 6,722,821 | B1 | 4/2004 | Perko et al. | |
| 7,004,683 | B1 | 2/2006 | Rupiper | |
| 7,748,932 | B2 | 7/2010 | Lindsey | |
| 2008/0302028 | A1 * | 12/2008 | Lewenhoff | 52/157 |
| 2012/0328374 | A1 * | 12/2012 | El Naggar et al. | 405/233 |
| 2013/0028666 | A1 * | 1/2013 | Atchley et al. | 405/251 |

* cited by examiner

*Primary Examiner* — John Kreck
*Assistant Examiner* — Stacy Warren
(74) *Attorney, Agent, or Firm* — Edwin H. Crabtree; Ramon L. Pizarro

(57) ABSTRACT

A helical pier for receipt in a ground surface and including an annular, adjustable, upper pierhead plate and an annular, adjustable, lower pierhead plate. The two plates include threaded bolts and nuts for securing the plates together in a spaced relationship. The upper and lower plates include a drive lug frame centered thereon. The pierhead plates are adapted for slidable receipt around a top portion of the helical pier. The helical pier includes spaced apart helice and spaced apart angular shaped drive lugs. The drive lugs are used for driving the helical pier into the ground surface. Also, the drive lug frames on the pierhead plates are received around selected drive lugs and secured thereto using set screws.

16 Claims, 3 Drawing Sheets

HELICAL PIER WITH ADJUSTABLE PIERHEAD PLATES FOR SUPPORTING A STRUCTURE ABOVE A GROUND SURFACE

BACKGROUND OF THE INVENTION (a) Field of the Invention

This invention relates to helical piers used for foundations and soil stabilization and more particularly but not by way of limitation, to an improved helical pier with one or more adjustable pierhead plates used for holding various structural items upright above a ground surface.

(b) Discussion of Prior Art

Heretofore, contractors have used different types and design of helical piers for foundation support, ground stabilization, and holding building and highway structures above a ground surface.

In U.S. Pat. No. 7,004,683 to Rupiper, a helice pierhead mounting plate and bolt assembly is disclosed and having mounting plates welded to a top portion of a helice pier shaft. In U.S. Pat. No. 5,934,836 to Michael R. Ludwig et al, a ground anchor device is illustrated having one or more hollow pipe sections with helice mounted thereon and a pipe extension for drilling the anchor device into a ground surface. The pipe sections include grout holes for introducing grout under pressure into a drill hole when the drilling has been completed.

None to the above mentioned prior art references provide the unique structural features, objects and advantages of the subject invention as described herein.

SUMMARY OF THE INVENTION

In view of the foregoing, it is a primary objective of the subject invention to provide a helical pier as a ground anchor with minimal displacement of the surrounding soil and at a substantial cost reduction when compared to a conventional concrete foundation.

Another object of the invention is the helical pier with adjustable pierhead plates can be quickly installed in locations with limited access and using a multitude of different types of drilling equipment. Also, the pier can be used in contaminated or environmentally sensitive locations. Further, the pier can be used effectively in various types of soil conditions.

Yet another key objection of the subject helical pier is by using one or more adjustable pierhead plates, various sizes and thickness of a concrete pad can be created next to the top of the ground surface for increased strength and stability when supporting different types and sizes of structures.

Still another object of the invention is the helical pier with adjustable pierhead plates can be used for supporting electrical transmission structures, pipeline supports, building foundations, streetlights, highway signage, and like applications.

The subject invention includes an annular, adjustable, upper pierhead plate and an annular, adjustable, lower pierhead plate. The two plates include treaded bolts and nuts for securing the plates together in a spaced relationship. The upper and lower plates include a drive lug frame centered thereon. The pierhead plates are adapted for slidable receipt around a top portion of a helical pier shaft. The helical pier shaft includes spaced apart helice and spaced apart angular shaped drive lugs. The drive lugs are used for driving the helical pier shaft into the ground surface. Also, the drive lug frames on the pierhead plates are received around selected drive lugs and secured thereon using set screws.

These and other objects of the present invention will become apparent to those familiar with the helical piers drilled into a top of a ground surface and used as a foundation for supporting various structures when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject helical pier with adjustable pierhead plates, and in which.

DETAILED DESCRIPTION OF THE PREFERRED EMBODIMENTS

Figure 1:
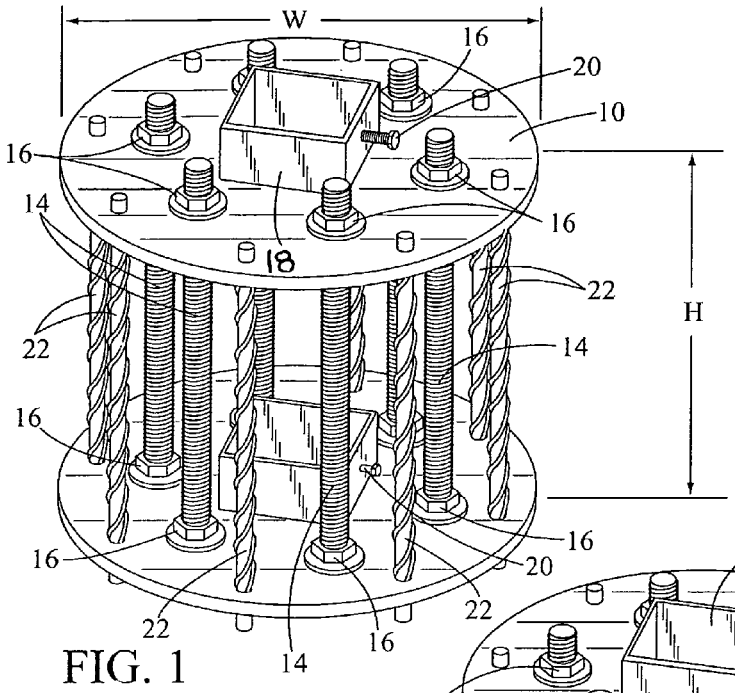
FIG. 1 is a perspective view of an annular shaped, adjustable, upper pierhead plate and an annular shaped, adjustable, lower pierhead plate. Threaded bolts and nuts are used to attach the plates together in a spaced relationship and prior to receipt on a top portion of a helical pier.
Figure 7:
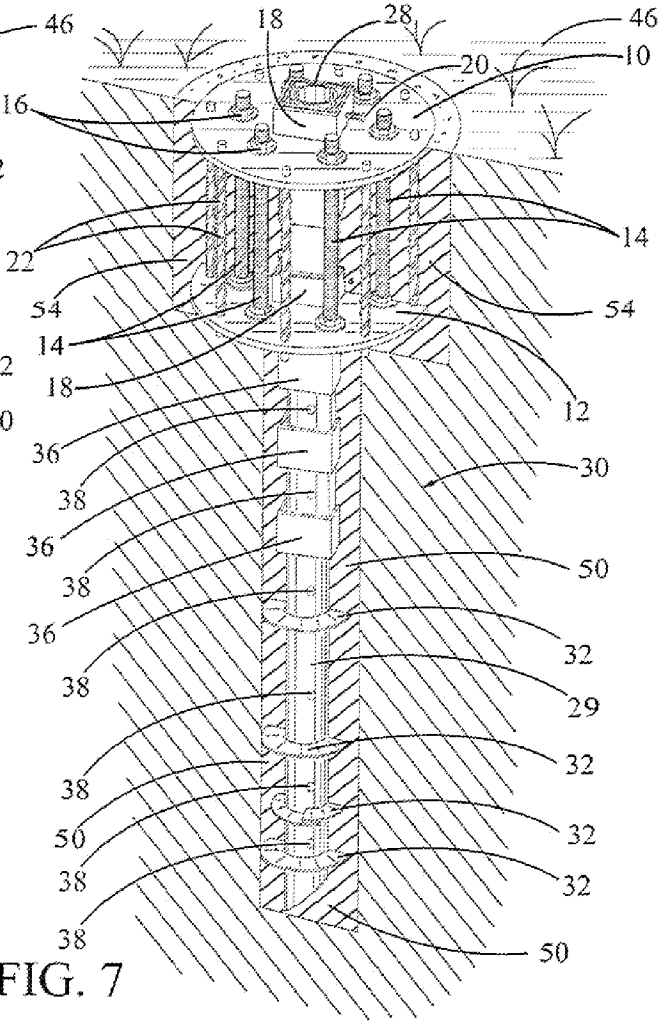
FIG. 7 is similar to FIG. 6 and illustrates concrete grout filled in an annular space in a drilled hole next to the helical pier shaft and between and around the adjustable upper and lower pierhead plates and forming a concrete pad.

In FIG. 1, a perspective view of an annular shaped, adjustable, upper pierhead plate 10 and an annular shaped, adjustable, lower pierhead plate 12 are illustrated with threaded bolts 14 and nuts 16 received through an upper circumference of the plates and used to attach the plates together in a spaced relationship. The spaced relationship between the two plates is a height "H", which can be typically 18 to 24 inches and greater. Also, the plates 10 and 12 have a width "W", which can be 18 to 24 inches and greater. While the plates are shown having an annular shape, it is appreciated that they can have various geometric shapes when used with a helical pier. Further, the plates 10 and 12 include a drive lug frame 18 centered thereon and with a set screw 20 threaded in one side of the frame. Concrete rebar 22 can also be added around the circumference of the plates for addition strength to a concrete pad created between the two plates as shown in FIG. 7.

Figure 2:
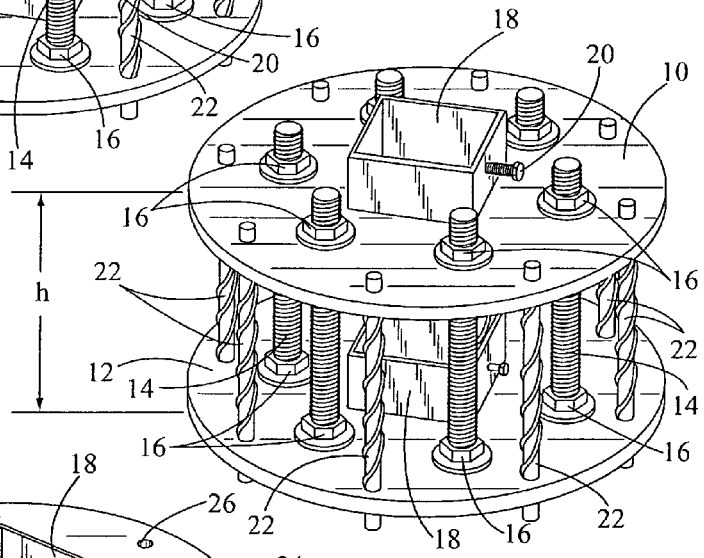
FIG. 2 is a perspective view of the upper and lower pierhead plates and adjusted on the threaded bolts for decreasing a height between the two plates.

In FIG. 2, a perspective view of the upper and lower pierhead plates 10 and 12 are shown and adjusted on the threaded bolts 14 for decreasing the height between the two plates. In this example, the height "h" is in a range of 12 to 15 inches.

Figure 3:
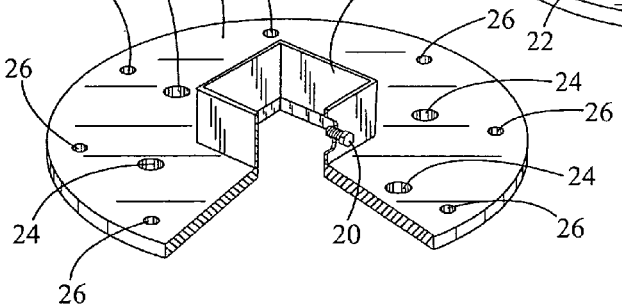
FIG. 3 is a perspective view of one of the pierhead plates with a portion of the plate cutaway.

In FIG. 3, a perspective view of one of the pierhead plate 10 is shown with a portion of the plate cutaway. This drawing illustrates the hollow drive lug frame 18, which is used for receipt around an upper portion of a helical pier shaft, shown in FIGS. 4, 6 and 7. In this drawing, bolt holes 24 and rebar holes 26 are shown disposed around a circumference of the plate for receiving a portion of the bolts 14 and rebar 22 therethrough.

Figures 4, 5:
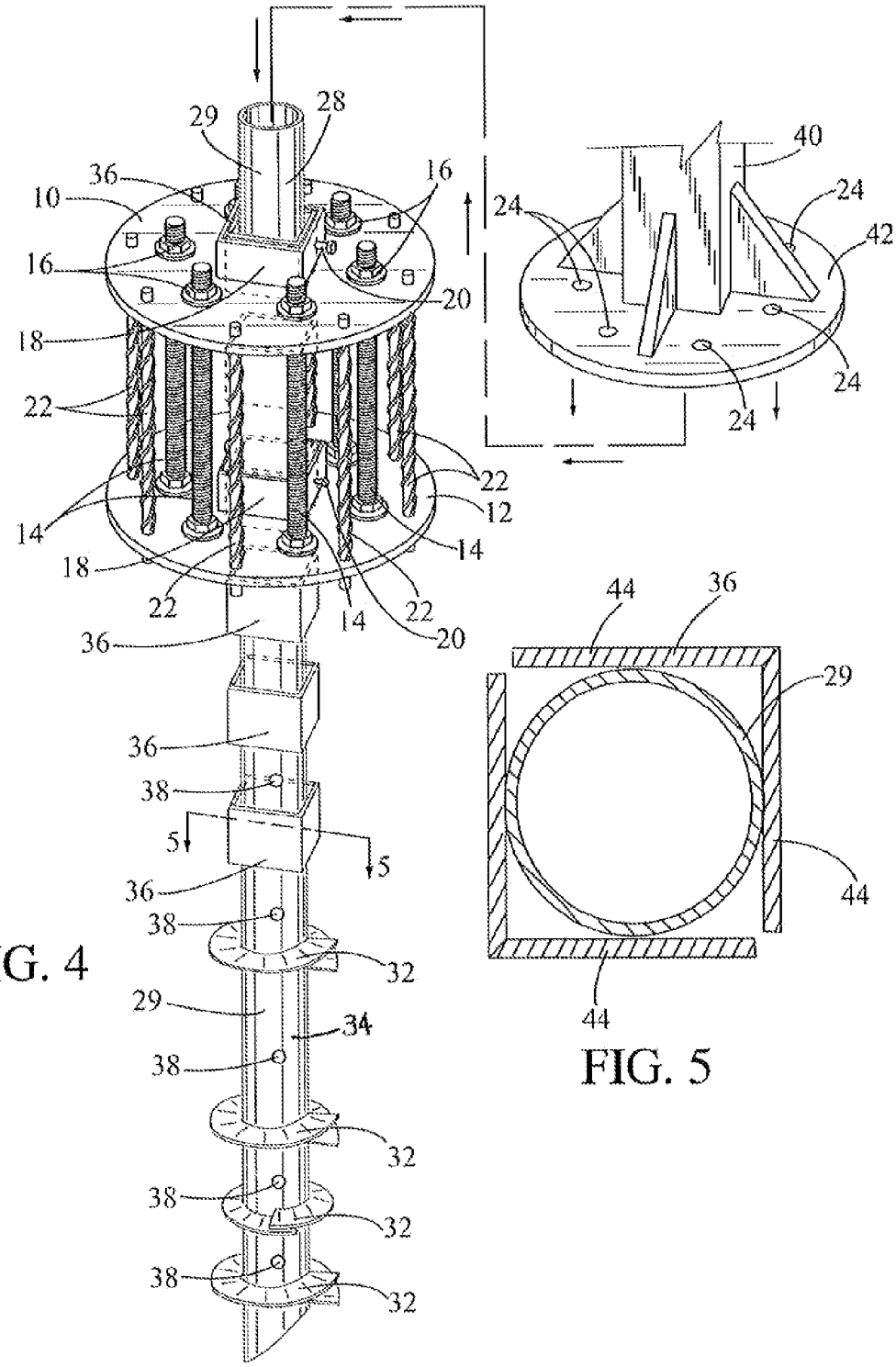
FIG. 4 is a perspective view of the adjustable, upper and lower pierhead plates slidably mounted on a top portion of a helical pier shaft, which is part of a helical pier. The helical pier shaft includes spaced apart helice and spaced apart drive lugs mounted thereon.
FIG. 5 is a cross sectional view of the helical pier taken along lines 5-5, shown in FIG. 4.

In FIG. 4, a perspective view of the adjustable, upper and lower pierhead plates 10 and 12 are shown slidably mounted on an upper portion 28 of a hollow pier shaft 29 of a helical pier. The helical pier is shown having general reference numeral 30. The hollow pier shaft 29 includes spaced apart helice 32 in a lower portion 34 thereof and spaced apart drive lugs 36 mounted on the upper portion 28 thereof. The pier shaft 29 also includes grout holes 38 disposed along its length. Grout is injected under pressure through the inside of the pier shaft 29 and along its length and out the grout holes 38 into an annular space in an adjacent hole screwed into the ground surface by the helice pier 30. In this drawing, a smaller helice 32 is shown disposed between the two lower helice 32 on the pier shaft 29. The smaller helice 32 helps spread the grout more evenly and more thoroughly next to the pier shaft as the helical pier is screwed in the ground surface.

The upper and lower pierhead plates 10 and 12 are attached to the pier shaft 29 when the drive lug frames 18 on the plates are indexed next to selected drive lugs 36 in the upper portion 28 of the pier shaft. The drive lugs 36 are typically spaced 6 inches apart on the pier shaft 29.

In this drawing, a utility light post 40, used as an example, is shown with a base mounting plate 42 and bolt holes 24 positioned above the upper pierhead plate 10 and ready for attachment thereto using the upper ends of the threaded bolts 14 and nuts 16.

In FIG. 5, a cross sectional view of the helical pier post 29 is shown and taken along lines 5-5, shown in FIG. 4. In this view, angular metal plates 44 are welded to the side of the post for forming the drive lug 36, which can be used for rotating the helical pier 30 into the ground and used for attaching the helical pier 30 to the upper and lower pierhead plates 10 and 12.

Figure 6:
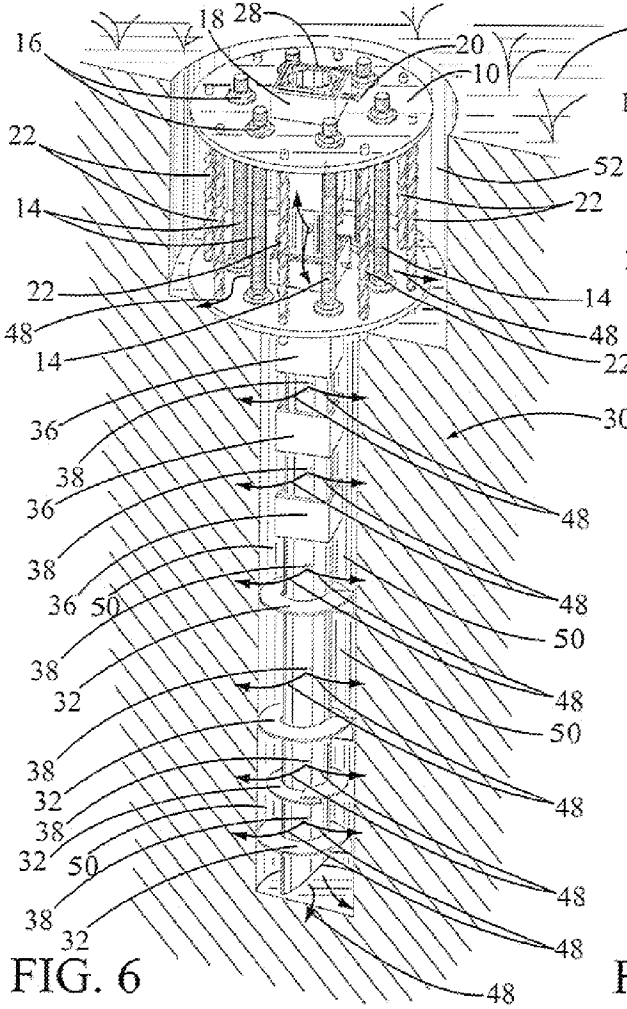
FIG. 6 is a perspective view of the helical pier with the helical pier shaft screwed into a ground surface with the adjustable upper pierhead plate disposed next to a top of the ground surface.

In FIG. 6, a perspective view of the helical pier 30 is shown drilled into a ground surface 46 with the adjustable upper pierhead plate 10 disposed next to the top of the ground surface. In this view, concrete grout, indicated by arrows 48, is shown being pumped outwardly from the upper portion 28 and lower portion 34 of the pier shaft 29 into a surrounding drilled pier shaft hole 50 next to the pier shaft and a surrounding pierhead plate hole 52 next to the upper and lower pierhead plates 10 and 12.

In FIG. 7, which is similar to FIG. 6, the concrete grout 48 has setup and filled the pier shaft hole 50 and filled the pierhead plate hole 52. Also, the grout 48 fills a space between the upper and lower pierhead plates 10 and 12 for forming a concrete pad 54. This combination of the grout 48 received around the helical pier 30 and around and between the plates 10 and 12 forms a strong and rigid foundation for supporting various structures thereon.

It is important to note, a key feature of the subject invention is the ability of the pierhead plates 10 and 12 to be adjusted apart to different distances "H" or "h", shown in FIGS. 1 and 2, and therefore provide different thickness of concrete pads 54 for added structural strength and prevent lateral movement of the attached structure to the helical pier 30 due to strong winds, earthquakes, and like natural forces. Also, it is important to note that while the upper and lower pierhead plates 10 and 12 are shown in the drawings, the upper pierhead plate 10 could be used with the threaded bolts 14 and rebar 22 secured in the concrete pad 54 or three or more pierhead plates could be used and mounted on the pier shaft 29 for added strength.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A helical pier for receipt in a ground surface, the helical pier comprising:

a first pierhead plate having an angular first drive lug frame centered thereon;

a second pierhead plate having an angular second drive lug frame centered thereon, the second pierhead plate disposed below the first pierhead plate; and a helical pier shaft, a lower portion of the pier shaft having spaced apart helices mounted thereon, an upper portion of the pier shaft having a plurality of spaced apart angular shaped drive lugs, the first drive lug frame on the first pierhead plate slidably received around a selected drive lug on the pier shaft, the second drive lug frame on the second pierhead plate slidably received around another selected drive lug on the pier shaft; wherein the first pierhead plate is attached to the second pierhead plate using a plurality of threaded bolts and nuts attached thereto.

2. The helical pier as described in claim 1 wherein the first and second pierhead plates are annular in shape and include a plurality of bolt holes around an outer circumference of the plates for receiving a portion of the threaded bolts therethrough.

3. The helical pier as described in claim 1 wherein the pier shaft includes a plurality of spaced apart grout holes along a length thereof and adapted for injecting concrete grout therethrough and into the ground surface.

4. The helical pier as described in claim 1 further including a plurality of rebar, ends of the rebar attached to an outer circumference of the first and second pierhead plates.

5. A helical pier for receipt in a ground surface, wherein the helical pier is used to create various sizes and thicknesses of a concrete pad, the helical pier comprising:

an annular shaped first pierhead plate having an angular first drive lug frame centered thereon;

an annular shaped second pierhead plate having an angular second drive lug frame centered thereon, the second pierhead plate disposed below the first pierhead plate; and a helical pier shaft, an upper portion of the pier shaft having a first, a second and a third spaced apart angular shaped drive lug, the first drive lug frame on the first pierhead plate slidably received around the first drive lug on the pier shaft, the second drive lug frame on the second pierhead plate slidably received around the second drive lug on the pier shaft, and a lower portion of the pier shaft having spaced apart helices mounted thereon; wherein the first pierhead plate is attached to the second pierhead plate using a plurality of threaded bolts and nuts attached thereto.

6. The helical pier as described in claim 5 wherein the pier shaft includes a plurality of spaced apart grout holes along a length thereof and adapted for injecting concrete grout therethrough and into the ground surface.

7. The helical pier as described in claim 5 further including a plurality of rebar, ends of the rebar attached to an outer circumference of the first and second pierhead plates.

8. The helical pier as described in claim 5 wherein the first and second drive lug frames are secured to the first and second drive lugs respectively, using a set screw.

9. The helical pier as described in claim 5 further including a third pierhead plate having a third drive lug frame centered thereon, the third drive lug frame slidably received around the third drive lug on the pier shaft, the third pierhead plate attached to the second pierhead plate using a plurality of threaded bolts and nuts.

10. The helical pier has described in claim 9 wherein the first, second and third pierhead plates are spaced apart 6 inches on the helical pier shaft.

11. A helical pier for receipt in a ground surface, wherein the helical pier is used to create various sizes and thicknesses of a concrete pad, the helical pier comprising:

an annular shaped first pierhead plate having an angular first drive lug frame centered thereon;

an annular shaped second pierhead plate having an angular second drive lug frame centered thereon and disposed below the first pierhead plate, the second pierhead plate attached to the first pierhead plate using a plurality of threaded bolts and nuts, the first and second pierhead plates having a plurality of bolt holes around a circumference of the plates for receiving a portion of the threaded bolts therethrough; and a helical pier shaft, an upper portion of the pier shaft having a first, a second and a third spaced apart angular shaped drive lug, the first drive lug frame on the first pierhead plate slidably received around the first drive lug on the pier shaft, the second drive lug frame on the second pierhead plate slidably received around the second drive lug on the pier shaft, and a lower portion of the pier shaft having spaced apart helices mounted thereon.

12. The helical pier as described in claim 11 further including a plurality of rebar, ends of the rebar attached to an outer circumference of the first and second pierhead plates.

13. The helical pier as described in claim 11 wherein the pier shaft includes a plurality of spaced apart grout holes along a length thereof and adapted for injecting concrete grout therethrough and into the ground surface.

14. The helical pier as described in claim 3 further including a plurality of rebar, ends of the rebar attached to an outer circumference of the first and second pierhead plates.

15. The helical pier as described in claim 11 wherein the first and second drive lug frames are secured to the first and second drive lugs respectively, using a set screw.

16. The helical pier as described in claim 11 further including a third pierhead plate having a third drive lug frame centered thereon, the third drive lug frame slidably received around the third drive lug on the pier shaft, the third pierhead plate attached to the second pierhead plate using a plurality of threaded bolts and nuts.

* * * * *